US006933012B2

(12) United States Patent
Das et al.

(10) Patent No.: US 6,933,012 B2
(45) Date of Patent: Aug. 23, 2005

(54) METHOD FOR PROTECTING A SURFACE WITH A SILICON-CONTAINING DIFFUSION COATING

(75) Inventors: Nripendra Nath Das, West Chester, OH (US); Bangalore Aswatha Nagaraj, West Chester, OH (US); Matthew David Saylor, Blanchester, OH (US); Jackie Lee King, Franklin, OH (US)

(73) Assignee: General Electric Company, Schenectady, NY (US)

( * ) Notice: Subject to any disclaimer, the term of this patent is extended or adjusted under 35 U.S.C. 154(b) by 58 days.

(21) Appl. No.: 10/318,762

(22) Filed: Dec. 13, 2002

(65) Prior Publication Data

US 2004/0115467 A1 Jun. 17, 2004

(51) Int. Cl.[7] ..... B05D 1/00

(52) U.S. Cl. ..... 427/252; 427/253; 427/388.1; 427/409

(58) Field of Search ..... 427/388.1, 252, 427/253, 409

(56) References Cited

U.S. PATENT DOCUMENTS

| | | | | |
|---|---|---|---|---|
| 3,037,883 A | * | 6/1962 | Wachtell et al. | 428/641 |
| 3,073,015 A | * | 1/1963 | Wachtell et al. | 428/652 |
| 3,257,230 A | | 6/1966 | Wachtell et al. | |
| 4,310,574 A | | 1/1982 | Deadmore et al. | |
| 4,369,233 A | | 1/1983 | van Schaik et al. | |
| 4,371,570 A | | 2/1983 | Goebel et al. | |
| 4,500,364 A | | 2/1985 | Krutenat | |

FOREIGN PATENT DOCUMENTS

| | | | |
|---|---|---|---|
| EP | 184354 | * | 6/1986 |
| GB | 1025841 | * | 4/1966 |
| JP | 08-209327 | * | 8/1996 |
| JP | 2001-122681 | * | 5/2001 |
| WO | WO 99/20383 | * | 4/1999 |

OTHER PUBLICATIONS

Wachtell et al, Fundam. Refract. Compounds, pp 249–267, 1968.*

Kositsin et al, Izvestiya Akademii Nauk SSSR, Neorganicheskie Materialy, 21(9), pp 1579–1582, 1985.*

Hirai et al, Nippon Kinzoku Gakkaishi, 51(12), pp 1180–1188, 1987.*

Xiang et al, Materials Science and Engineering, A: Structural Properties, Microstructure and Processing, A356(1–2), pp136–144, 2003.*

* cited by examiner

*Primary Examiner*—Erma Cameron
(74) *Attorney, Agent, or Firm*—McNees Wallace & Nurick LLC

(57) ABSTRACT

A surface of an article is protected by coating the surface with a silicon-containing coating by preparing a coating mixture of silicon, a halide activator, and an oxide powder, positioning the surface of the article in gaseous communication with the coating mixture, and heating the surface of the article and the coating mixture to a coating temperature of from about 1150° F. to about 1500° F. The article is preferably a component of a gas turbine engine made of a nickel-base superalloy.

19 Claims, 2 Drawing Sheets

FIG. 1
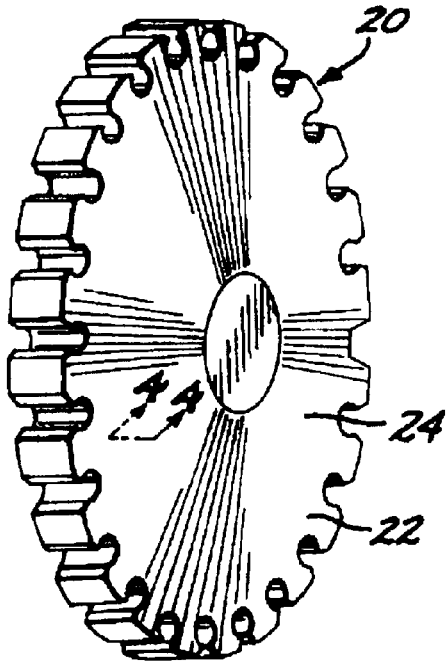
FIG. 3
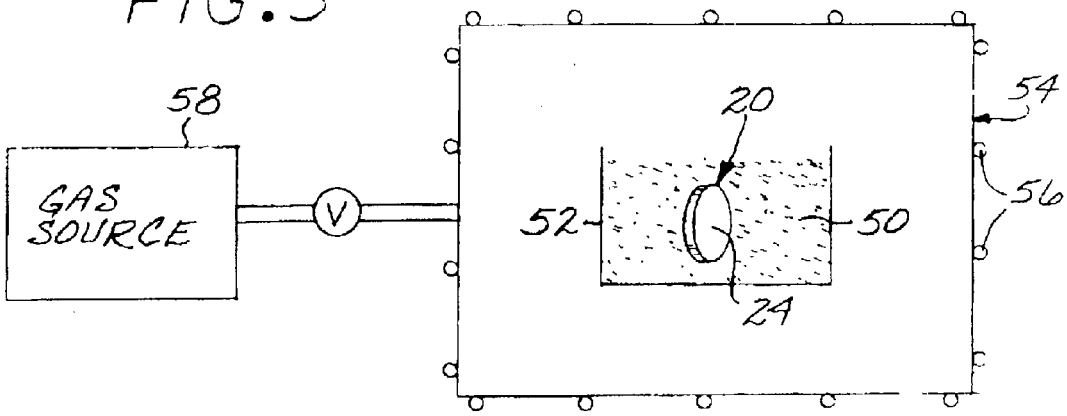
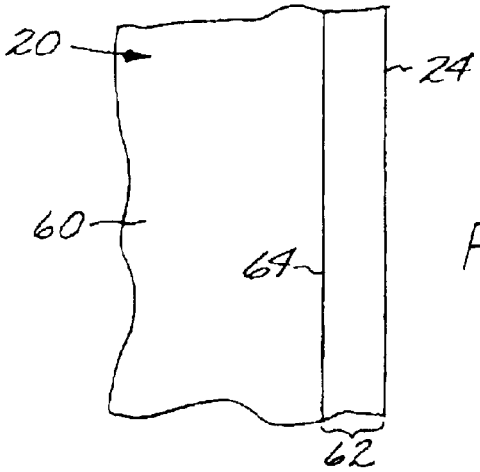
FIG. 4

METHOD FOR PROTECTING A SURFACE WITH A SILICON-CONTAINING DIFFUSION COATING

This invention relates to the protection of a surface with a coating, and more particularly to the protection of a nickel-base superalloy gas turbine component with a silicon-containing coating.

BACKGROUND OF THE INVENTION

In a basic form of an aircraft gas turbine (jet) engine, air is drawn into the front of the engine, compressed by a shaft-mounted compressor, and mixed with fuel. The mixture is burned, and the hot combustion gas is passed through a turbine mounted on the same shaft. The turbine includes a turbine disk (sometimes termed the "rotor"), upon which turbine blades are mounded. The flow of combustion gas turns the turbine by impingement against an airfoil section of the turbine blades, which turns the shaft and provides power to the compressor. Seals prevent the leakage of hot combustion gas around the turbine. After passing through the turbine, the hot combustion gas flows from the back of the engine, driving it and the aircraft forward.

In prior generations of aircraft gas turbine engines, the turbine disks and seal components operated at a sufficiently low temperature that hot corrosion was not a major concern. In current and advanced gas turbine engines, however, some of the components, such as the turbine disk and some of the seal components, are operated at a sufficiently high temperature that they are subjected to hot corrosion during operation. The corrodant is introduced into the turbine section of the engine in the hot combustion gases. The corrodant typically includes alkaline sulfate deposits that may have carbon as well.

Nickel-base superalloys are used as the materials of construction of some types of turbine disks and seal components. In service, the nickel-base superalloys are exposed to hot corrosion in the intermediate temperature range of about 1000° F. to about 1500° F. The compositions of the nickel-base superalloys are selected to achieve the required mechanical properties in service. However, the superalloys that have the desired mechanical properties are not sufficiently resistant to hot-corrosion damage. The hot-corrosion damage, if it becomes sufficiently severe, may cause the superalloy component to fail prematurely.

Environmentally resistant coatings are known for use with nickel-base superalloys operated at higher temperatures. Aluminum-containing diffusional and overlay coatings that oxidize to produce a protective aluminum oxide scale are widely used. However, these coatings are typically not suitable for use on wrought gas turbine components operated in the temperature range of about 1000° F. to about 1500° F., because they require higher deposition temperatures that adversely affect the mechanical properties of the heat-treated wrought nickel-base superalloys.

There is a need for an improved approach to the protection of nickel-base superalloys and other materials operated in a corrosive environment in the temperature range of about 1000° F. to about 1500° F. The new approach must be compatible with the processing of the component. The present invention fulfills this need, and further provides related advantages.

BRIEF SUMMARY OF THE INVENTION

The present approach provides a method for protecting a surface of an article. It is particularly useful for protecting a component of a gas turbine engine that is operated in a temperature range of from about 1000° F. to about 1500° F. and potentially subject to hot corrosion from the hot combustion gases, such as gas turbine disks and some seal components. The present approach protects the surface of the article, is compatible with the thermomechanical processing of wrought nickel-base superalloys used to manufacture the articles, and is compatible with achieving and maintaining the mechanical properties required in the article. The coating approach is not limited by line of sight access to the surface that is to be protected. It is also environmentally friendly and readily used in commercial operations.

A method for protecting a surface of an article comprises the steps of providing the article having the surface thereon, and thereafter coating the surface with a silicon-containing coating. The coating is accomplished by preparing a coating mixture having silicon, a halide activator, and an oxide powder, positioning the surface of the article in gaseous communication with the coating mixture, and heating the surface of the article and the coating mixture to a coating temperature of from about 1150° F. to about 1500° F., typically in an oven. Most preferably, the surface is contacted to the coating mixture, as by packing the coating mixture around and in contact with the surface.

The coating mixture preferably has from about 2 to about 10 percent by weight of silicon powder, from about 0.1 to about 0.5 percent by weight of a halide activator, and the balance aluminum oxide powder. The coating is preferably performed in an inert atmosphere or hydrogen. The heating time is determined by the desired thickness of the protective layer, but is typically on the order of from about 2 to about 8 hours.

The article is preferably made of a nickel-base superalloy, and most preferably a wrought nickel-base superalloy. Examples of such articles are components of a gas turbine engine, such as turbine disks and seals. The surface of the article may be mechanically worked before it is coated.

The resulting article is preferably a component of a gas turbine engine having a nickel-base superalloy substrate composition, with a protective layer at the surface of the component. The protective layer comprises a mixture of silicon and elements from the substrate composition interdiffused with the silicon. Most preferably, the protective layer consists essentially of a mixture of silicon and elements from the substrate composition interdiffused with the silicon.

The protected article is preferably operated in a gas turbine at an operating temperature of from about 1000° F. to about 1500° F. and contacted by hot combustion gas.

When the coating mixture is heated during the coating step, the chemical reaction between the silicon and the halide activator produces a silicon-containing gas. An example is silicon fluoride in the case of a fluoride-containing activator. The silicon-containing gas is transported to the component, which serves as a substrate for the deposition of the silicon-containing gas. Upon contacting the surface of the substrate, the silicon-containing gas decomposes to deposit silicon on the substrate. Because the reaction and the vapor-phase transport are performed at elevated temperatures, the silicon interdiffuses with elements from the substrate composition to produce a silicon-rich surface layer. The silicon-rich surface layer protects the article against corrosion by the corrosive components of the hot combustion gas.

The present protection approach, which does not require that the component be heated during processing to a temperature above its normal service operating temperature, is fully compatible with the thermomechanical and other processing treatments of wrought nickel-base superalloys that are used in the preferred components such as gas turbine disks and seals. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 1 is a perspective view of a protected component of a gas turbine engine;

FIG. 3 is a schematic sectional view of a coating apparatus with the article packed in the coating mixture; and FIG. 4 is a schematic sectional view of the protected component of FIG. 1, taken on line 4—4.

DETAILED DESCRIPTION OF THE INVENTION

Figure 2:
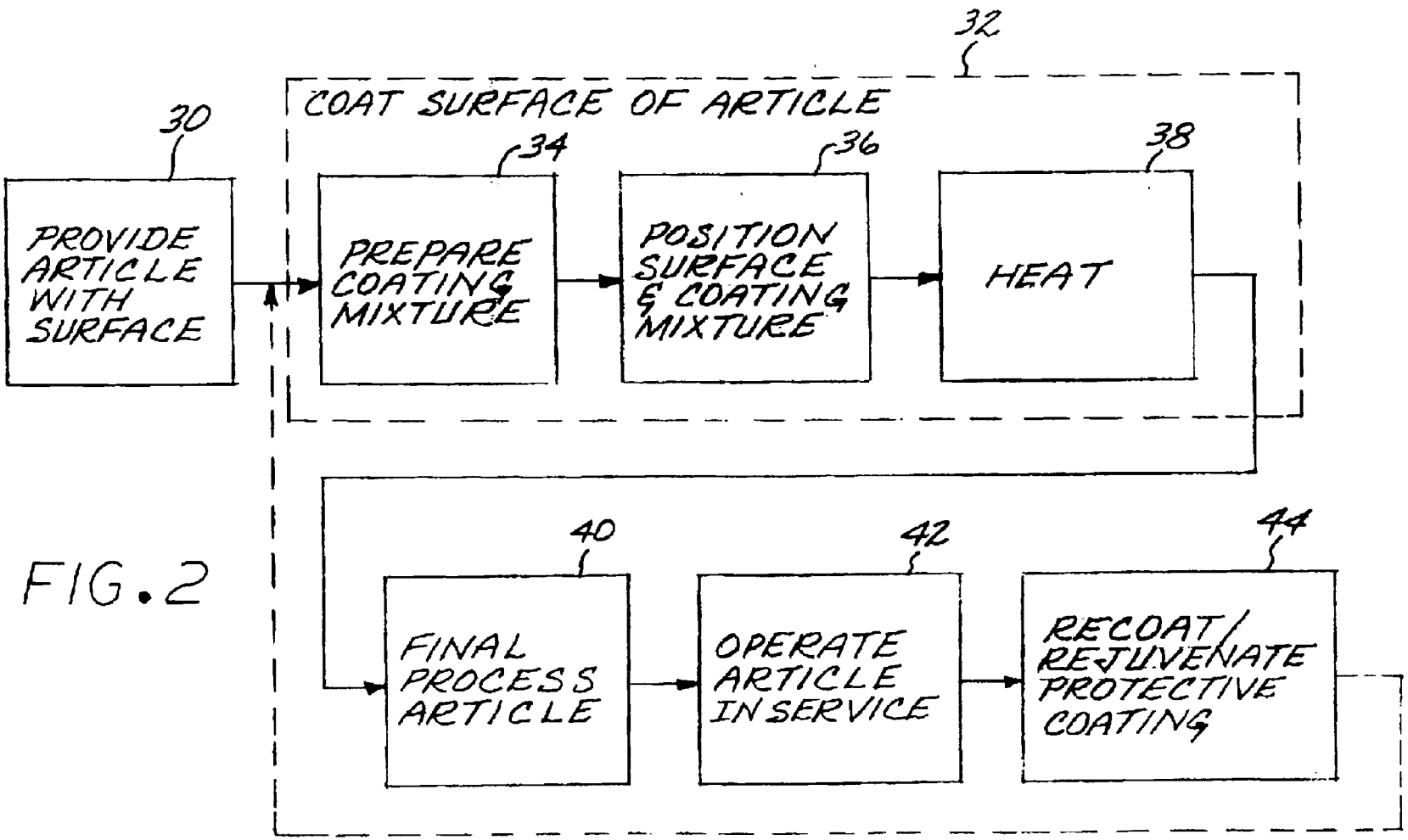
FIG. 2 is a block flow diagram of an approach for protecting the component.

The present approach may be used to process a wide variety of physical forms of workpieces to produce a wide variety of final articles 20. Components of gas turbine engines are of particular interest. FIG. 1 illustrates one such article 20, a turbine disk 22 having an article surface 24. Other components include, for example, seals and compressor components. The present approach is not limited to the production of these articles, however.

FIG. 2 depicts a preferred approach for protecting the surface 24 of the article 20. The article 20 having the article surface 24 thereon is provided, step 30. The article 20 is furnished in substantially its final size and shape, and underlying base-metal composition. The surface protection treatment to be described subsequently alters the dimensions of the article only very slightly.

The article 20 is preferably made of a nickel-base alloy as the base metal, and is most preferably made of a nickel-base superalloy. A nickel-base alloy is a composition of matter having more nickel than any other element. A nickel-base superalloy is a nickel-base alloy that is hardenable by the precipitation of gamma prime or a related phase. A presently preferred nickel-base superalloy that is to be protected by the present approach is Rene™ 88DT, having a nominal composition, in weight percent, of 13 percent cobalt, 16 percent chromium, 4 percent molybdenum, 3.7 percent titanium, 2.1 percent aluminum, 4 percent tungsten, 0.75 percent niobium, 0.015 percent boron, 0.03 percent zirconium, and 0.03 percent carbon, up to about 0.5 percent iron, balance nickel and minor amounts of other elements. Another example is alloy ME3, having a nominal composition, in weight percent, of about 20.6 percent cobalt, about 13.0 percent chromium, about 3.4 percent aluminum, about 3.7 percent titanium, about 2.4 percent tantalum, about 0.90 percent niobium, about 2.10 percent tungsten, about 3.80 percent molybdenum, about 0.05 percent carbon, about 0.025 percent boron, about 0.05 percent zirconium, up to about 0.5 percent iron, balance nickel and minor amounts of other elements. These alloys are presented by way of example, and the use of the present invention is not so limited.

The nickel-base superalloy is desirably a wrought nickel-base superalloy, which is cast and then mechanically worked, usually by thermomechanical working at elevated temperature such as by forging, to reach the shape of the article 20. It may also be heat treated prior to working, at intermediate points in the working process, and after working. The details of the working and heat treating are known in the art for each alloy.

The surface 24 of the article 20 may be mechanically worked or otherwise processed as a final stage of the providing step 30. For example, the article surface 24 may be shot peened to induce a desired stress state into the article surface 24. It may optionally be grit blasted or vapor honed.

The working, heat treating, mechanical working, and other processing produce a desired structure and stress state at the surface 24 and in the microstructure of the article 20. This structure and stress state may not be disturbed or altered by heating the article 20 to a temperature of greater than about 1500° F. in subsequent processing, or the mechanical performance under service conditions of the article 20 will be adversely affected.

The article surface 24 is thereafter coated with a silicon-containing coating, step 32. The coating operation 32 first includes preparing a coating mixture of silicon, a halide activator, and an oxide powder, step 34. The silicon is preferably furnished as silicon powder of any operable size, most preferably −100 mesh. The halide activator is of any operable type. Operable halide activators include, for example, ammonium fluoride, ammonium chloride, sodium fluoride, sodium chloride, sodium bromide, sodium iodide, potassium fluoride, potassium chloride, potassium bromide, potassium iodide, aluminum fluoride, and aluminum chloride, or mixtures thereof. Most preferably, the halide activator is an ammonium halide or an aluminum halide. The oxide powder is inert in the coating operation and serves to slow the coating process and prevent agglomeration of the powders that would prevent access of the coating vapor to the surface 24. The oxide powder is preferably aluminum oxide (alumina, or $Al_2O_3$). Any operable oxide powder size may be used, but a preferred size is −325 mesh.

A preferred composition of the coating mixture is from about 2 to about 10 percent by weight of silicon powder, from about 0.1 to about 0.5 percent by weight of a halide activator, and the balance aluminum oxide powder.

The surface 24 of the article 20 is positioned in gaseous communication with the coating mixture, step 36. Any operable approach may be used, but the presently preferred approach, illustrated in FIG. 3, is to pack the coating mixture 50 in contact with the surface 24 of the article, as by packing the entire article 20 in the coating mixture 50. For example and as illustrated, the article 20 may be placed into a container 52, and the solid coating mixture 50 is poured into the container 52 to surround and immerse the article 20.

The surface 24 of the article 20 and the coating mixture 50 are thereafter heated to a coating temperature of from about 1150° F. to about 1500° F., step 38. If the coating temperature is lower than about 1150° F., the rate of coating is too slow to be commercially feasible. If the coating temperature is greater than about 1500° F., the stress state, structure, and/or microstructure of the underlying article 20 are adversely affected.

The preferred approach is to heat the surface 24 of the article 20 and the coating mixture 50 in an oven 54, see FIG. 3. The oven 54 may be of any operable type, but is represented as an electrically heated oven with electrical heating coils 56. The heating 38 is preferably performed in an inert-gas (e.g., argon) or hydrogen-reducing atmosphere, supplied by a gas source 58.

The heating causes the halide activator to react with the silicon to produce a gaseous form. For example, if the halide activator is ammonium fluoride, the ammonium fluoride decomposes to produce fluoride ions. The fluoride ions react with the silicon to produce a silicon-bearing gas such as gaseous silicon fluoride ($SiF_6$ or a related form). The silicon-bearing gas diffuses to the surface 24 of the article 20. Upon contacting the surface 24, the silicon-bearing gas decomposes to deposit silicon upon the surface 24.

The article 20 thereby serves as a substrate 60 for the deposition of the silicon and thence the protective coating 62, as shown in FIG. 4. The silicon is initially deposited in elemental form. However, because the deposition is performed at elevated temperature, the deposited silicon interdiffuses with the base metal of the substrate composition, which is a nickel-base superalloy in the preferred embodiment. The protective coating 62 is therefore a diffusion coating whose composition is a gradient composition extending through the protective coating 62. At the surface 24, the protective coating 62 has its greatest percentage silicon content and lowest percentage content of base-metal elements from the substrate 60. The portion of the protective coating 62 at and nearest the surface 24 may be substantially completely pure silicon, if the silicon deposition in step 38 is continued for a sufficiently long time. With increasing distance below the surface 24, the percentage of silicon in the coating is reduced, and the percentage of the base-metal elements of the substrate 60 increases until it reaches 100 percent at the greatest depth 64 of the protective coating 62. Optionally but not preferably at the present time, other elements may be co-deposited with the silicon to become part of the protective coating 62.

The heating step 38 is continued for a time sufficient to produce the protective coating 62 of a desired thickness. A preferred coating temperature range of from about 1250° F. to about 1400° F. for a time of from about 2 to about 8 hours has been found sufficient for most applications of interest. For example, a heating step 38 of about 5 hours at a coating temperature of about 1400° F. produces a protective coating 62 about 0.0007 inch thick. The coating temperature may, however, range as low as 1150° F. and as high as 1500° F., as discussed earlier.

After the coating 32 is complete, the article 20 with the protective coating 62 thereon is final processed, step 40. The final processing may include, for example, thermal treatments, final machining of uncoated portions, and cleaning.

The article 20 with the protective coating 62 in place is operated in service, step 42. In the preferred application, the article 20 is operated at an operating temperature of from about 1000° F. to about 1500° F. and contacted by hot combustion gas for an extended period of time.

One of the advantages of the present approach is that, after service, the protective coating 62 may be restored and rejuvenated by recoating, step 44. During service, it is expected that some of the protective coating 62 would be corroded or eroded away, or otherwise lost. To some extent the as-deposited protective coating 62 is "self-healing", as any excess silicon in the protective coating 62 may interdiffuse with the substrate 60 during service. Eventually, however, the protective coating 62 becomes thinner and in some places may be lost entirely. To perform the recoating, step 32 is repeated after the article 20 is cleaned, and all service-produced residue removed. Step 40 may optionally be repeated as necessary. The article 20 may then be returned to service, step 42. Subsequent recoatings/rejuvenations are permissible.

The present approach has been reduced to practice. Flat panel specimens of Rene™ 88DT were coated by the preferred approach discussed above. The coated flat panel specimens and uncoated specimens of Rene™ 88DT were exposed at 1300° F. to a sodium sulfate corrodant mixture and periodically evaluated. The coated specimens had about three times the life of the uncoated specimens.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for protecting a surface of an article, comprising the steps of providing the article in a cast-and-mechanically worked form having the surface thereon, wherein a structure and stress state of the article may not be altered by heating the article to a temperature of greater than about 1500° F. in subsequent processing; and thereafter coating the surface with a silicon-containing coating by the steps of preparing a coating mixture having silicon, a halide activator, and an oxide powder, positioning the surface of the article in gaseous communication with the coating mixture, and heating the surface of the article and the coating mixture to a coating temperature of from about 1150° F. to about 1500° F.

2. The method of claim 1, wherein the step of providing the article includes the step of providing the article made of a nickel-base superalloy.

3. The method of claim 1, wherein the step of providing the article includes the step of mechanically working the surface of the article.

4. The method of claim 1, wherein the step of providing the article includes the step of providing a component of a gas turbine engine.

5. The method of claim 1, wherein the step of preparing the coating mixture includes the step of preparing the coating mixture having from about 2 to about 10 percent by weight of silicon powder, from about 0.1 to about 0.5 percent by weight of a halide activator, and the balance aluminum oxide powder.

6. The method of claim 1, wherein the step of positioning the surface includes the step of packing the coating mixture in contact with the surface.

7. The method of claim 1, wherein the step of heating includes the step of heating the surface of the article and the coating mixture in an oven.

8. The method of claim 1, wherein the step of heating includes the step of heating the surface of the article and the coating mixture to the coating temperature of from about 1250° F. to about 1400° F. for a time of from about 2 to about 8 hours.

9. The method of claim 1, wherein the step of heating includes the step of heating the surface of the article and the coating mixture in an atmosphere selected from the group consisting of an inert gas and hydrogen.

10. The method of claim 1, including an additional step, after the step of coating, of operating the article in a gas turbine at an operating temperature of from about 1000° F. to about 1500° F. and contacted by hot combustion gas.

11. The method of claim 1, wherein the step of providing the article includes the step of providing the article as a turbine disk, a seal, or a compressor component.

12. The method of claim 1, including additional steps, after the step of coating, of operating the article in a gas turbine at an operating temperature of from about 1000° F. to about 1500° F. and contacted by hot combustion gas, and thereafter recoating the article with a second silicon-containing coating by the steps of preparing a coating mixture having silicon, a halide activator, and an oxide powder, positioning the article in gaseous communication with the coating mixture, and heating the article and the coating mixture to a coating temperature of from about 1150° F. to about 1500° F.

13. A method for protecting a surface of an article, comprising the steps of providing a cast-and-mechanically worked nickel-base superalloy article that is a component of a gas turbine engine and has the surface thereon, wherein a structure and stress state of the article may not be altered by heating the article to a temperature of greater than about 1500° F. in subsequent processing; and thereafter coating the surface with a silicon-containing coating by the steps of preparing a coating mixture of silicon, a halide activator, and an oxide powder, positioning the surface of the article in gaseous communication with the coating mixture by packing the coating mixture in contact with the surface, and heating the surface of the article and the coating mixture in an oven to a coating temperature of from about 1150° F. to about 1500° F. in an atmosphere selected from the group consisting of an inert gas and hydrogen.

14. The method of claim 13, wherein the step of providing the article includes the step of mechanically working the surface of the article.

15. The method of claim 13, wherein the step of preparing the coating mixture includes the step of preparing the coating mixture having from about 2 to about 10 percent by weight of silicon powder, from about 0.1 to about 0.5 percent by weight of a halide activator, and the balance aluminum oxide powder.

16. The method of claim 13, wherein the step of heating includes the step heating the surface of the article and the coating mixture to the coating temperature of from about 1150° F. to about 1500° F. for a time of from about 2 to about 8 hours.

17. The method of claim 13, including an additional step, after the step of coating, of operating the article in a gas turbine at an operating temperature of from about 1000° F. to about 1500° F. and contacted by hot combustion gas.

18. The method of claim 13, wherein the step of providing the article includes the step of providing the article as a turbine disk, a seal, or a compressor component.

19. The method of claim 13, including additional steps, after the step of coating, of operating the article in a gas turbine at an operating temperature of from about 1000° F. to about 1500° F. and contacted by hot combustion gas, and thereafter recoating the article with a second silicon-containing coating by the steps of preparing a coating mixture having silicon, a halide activator, and an oxide powder, positioning the article in gaseous communication with the coating mixture, and heating the article and the coating mixture to a coating temperature of from about 1150°F. to about 1500° F.

* * * * *